US005658314A

United States Patent [19]

Scheffer et al.

[11] Patent Number: 5,658,314

[45] Date of Patent: Aug. 19, 1997

[54] TEETHER PACIFIER SYSTEM WITH A COOLING CARRIER SHEATH

[76] Inventors: Mary Scheffer; David Scheffer, both of 390-C Village II Dr., Hilton, N.Y. 14468

[21] Appl. No.: 239,506

[22] Filed: May 9, 1994

[51] Int. Cl.[6] ..... A61J 17/00; F25D 3/08; A45C 11/20

[52] U.S. Cl. ..... 606/235; 62/457.1; 206/545

[58] Field of Search ..... D24/194–199; 606/234–236; 62/371, 372, 457.1–457.7; 206/545; 383/901

[56] References Cited

U.S. PATENT DOCUMENTS

| | | | |
|---|---|---|---|
| 2,514,844 | 7/1950 | Cohen | 606/235 |
| 2,566,595 | 9/1951 | Cameron | 606/235 |
| 2,703,087 | 3/1955 | Newmark | 606/235 |
| 2,730,151 | 1/1956 | Smith | 62/457.1 |
| 3,669,117 | 6/1972 | Herbst | 606/234 |
| 3,875,940 | 4/1975 | Beuther | 606/234 |
| 4,228,908 | 10/1980 | Tweeton | 206/545 |
| 4,796,758 | 1/1989 | Hauk | 206/545 |
| 5,160,344 | 11/1992 | Werton | 606/235 |

*Primary Examiner*—Glenn Dawson
*Attorney, Agent, or Firm*—International Inventor's Club

[57] ABSTRACT

A teething pacifier system provides a teething pacifier that, placed in an infant's mouth and without re-orienting, acts as a cooled teether and then gradually becomes pacifier-like in accordance with natural infant tiring. The system includes a supple yet durable tubular teething pacifier containing a freezable fluid, preferably distilled water. An integral reservoir provides for fluid expansion during freezing and for fluid runoff such that the integral nipple becomes collapsible and otherwise pacifier-like as the fluid thaws. In a preferred embodiment, the system also includes a flexible pocket strip and a carrying pouch. The pocket strip orients and protects one or more teething pacifiers during freezing while molding to available freezer space. After freezing and where continued cooling is not needed, the pocket strip can be carried directly or affixed to the outside of the carrying pouch. Where a longer time may elapse prior to use, the pocket strip can be placed inside the carrying pouch along with conventional ice packs. In addition to insulating and cooling frozen teething pacifiers, the carrying pouch can also be used to carry other articles. Preferably the carrying pouch is flexible for occupying minimal space when carried directly or when placed inside another bag or carrying container.

3 Claims, 3 Drawing Sheets

TEETHER PACIFIER SYSTEM WITH A COOLING CARRIER SHEATH

BACKGROUND OF THE INVENTION

1. Field of Invention

This invention relates generally to infant care devices and more specifically to pacifiers and teethers.

2. Description of Prior Art

Devices for soothing and quieting infants without constant parental intervention are well known.

Pacifiers of various designs attempt to provide temporary comfort or lull the infant to sleep by simulating a natural nipple. Geitner et al, Des 326,919; Herritz, Des 312,312; Bubelis, Des 267,116. In addition to accommodating instinctive sucking, pacifiers provide a narrow and flexible area near the shied end of the nipple, allowing a full and natural biting motion. Many also provide a handle for inserting, supporting and removing the pacifier from the infant's mouth. One disadvantage of the current pacifiers is that they provide no relief for the discomfort accompanying the introduction of the infant's first teeth.

Teething rings attempt to soothe discomfort resulting from the introduction of the infant's first teeth. In addition to providing a stiff biting surface, many also contain a freezable liquid for cooling the infant's gums, numbing the gums and relieving teething pain. Werton, U.S. Pat. No. 5,160,344.

One disadvantage of present teething rings is that while they soothe teething pain, their permanent stiffness prevents the instinctive sucking motion well accommodated by pacifiers. A second disadvantage is that the ring-like shape does not accommodate natural sucking or provide a natural nipple feel. These factors become particularly important as an infant begins to tire following the work of teething and instinctively desires the more nipple like qualities of a pacifier. In addition, infants are ill equipped to grasp the ring and reluctant to endure the cooling of the hands. So in contrast to a pacifier, an infant will tend to expel a ring and require assistance on a continual basis. A third disadvantage is that freezable teething rings must be used immediately upon removal from the freezer. Given the variety of real life interruption possibilities, such a requirement is impractical.

Thus there is a need for a device that automatically accommodates the cool, stiff surface requirements of teething as well as the flexible biting area and natural, nipple-like sucking area typically accommodated by pacifiers.

SUMMARY OF THE INVENTION

The present invention is a teething pacifier and cooling pouch system which is specifically intended to provide, on demand, a single device that can be inserted into the mouth of an infant and; act as a teether or pacifier; transform gradually from teether to pacifier to accommodate the infant's natural teething, pacifying and then sleeping cycle; or cool a feverish infant's mouth to make the infant more comfortable.

The teether pacifier system according to the present invention provides two components. The first component is intended to be used be used by a child primarily unattended as a cooled, rigid teether and/or pacifier and can be placed in a conventional freezer for freezing. The second component can be used by parents to support one or more teething pacifiers, germ free, inside a freezer or cooling device, during removal from the freezer or cooling device and with continued cooling and insulating after removal and prior to use.

Accordingly, it is an object of the present invention to provide a teether pacifier which is structured to become stiffened and teether like when cooled, and which, without parental intervention or substantial re-orientation softens, becoming pacifier like as it warms to room temperature, thereby accommodating natural shifts in the needs of a child.

A second object of the invention is to assure a natural, nipple-like shape and resiliency while the teether pacifier is acting as a pacifier or when cooled to provide relief for feverish infants.

A third object of the invention is to provide a cooling sheath for proper positioning of one or more teething pacifiers during cooling as well as for continued cooling, insulating and carrying of the teething pacifiers until use, both is a known, convenient and sanitary environment.

These and other objects, advantages, features and benefits of the present invention will become apparent from the drawings and specification that follow.

DETAILED DESCRIPTION OF THE PREFERRED EMBODIMENT

Figure 1:
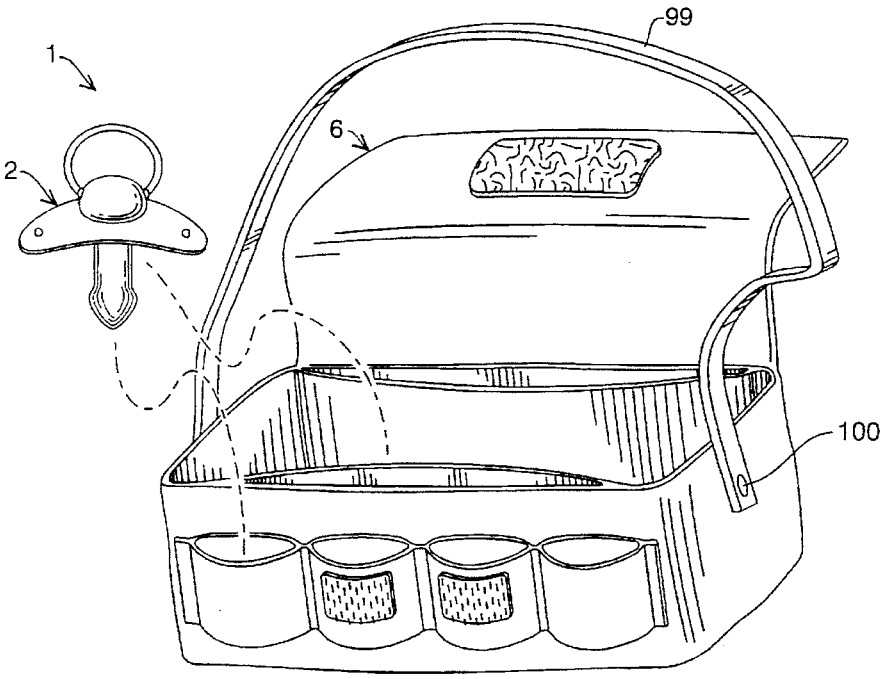
FIG. 1 shows how the Teething Pacifier System provides a teething pacifier that is received within the main compartment or a removable pocket strip of an integral cooling sheath.

Referring to the drawing, FIG. 1 shows generally how the teething pacifier system ("System") 1 includes a specially shaped and constructed teether/pacifier 2 and cooling sheath 6. The teether pacifier 2 contains a freezable liquid within a specially designed cavity. When frozen, the teether pacifier 2 acts as a rigid teether that gradually follows an infant's instinctive needs, becoming flexible and pacifier-like through melting and proper fluid distribution. When not frozen or when fully melted, the teether pacifier 2 appears to an infant as a would a conventional pacifier. The cooling sheath 6 acts to properly orient one or more teething pacifiers 2 during freezing, provides insulation for and for continued cooling of the teething pacifiers 2 after freezing and, in both instances, prevents contamination of the teether/pacifiers 2 until use.

Figure 3:
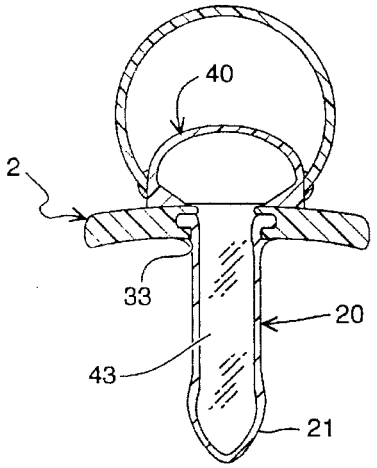
FIG. 3 shows how the teether pacifier is frozen in a vertical orientation in order to provide a cooled and stiffened nipple for teething.
Figure 4A:
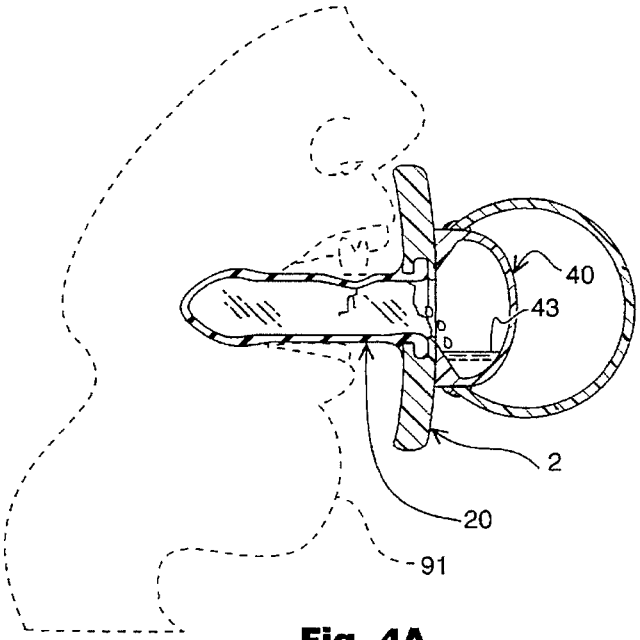
FIG. 4*a* shows how extension of the inner cavity into an integral reservoir provides for handling liquid and separated frozen material as an infant teethes.
Figure 4B:
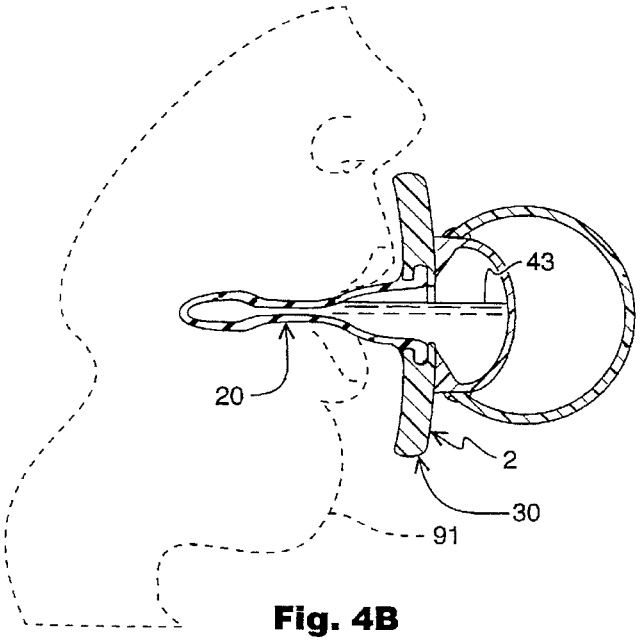
FIG. 4*b* shows how the reservoir allows maximum compression of the nipple while the teething pacifier is acting as a pacifier by receiving excess liquid.
Figure 5:
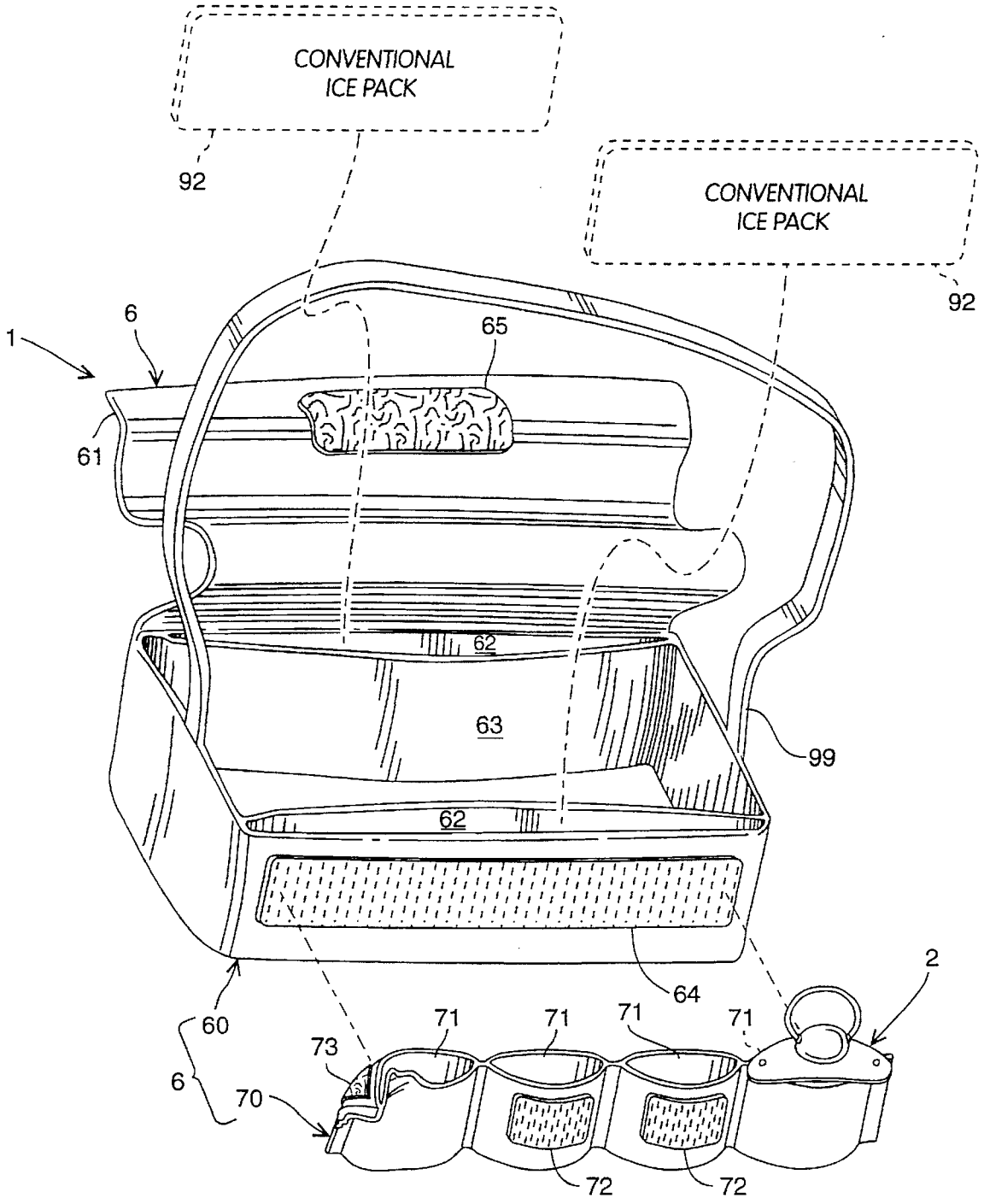
FIG. 5 shows how the cooling sheath includes a compartmentialized flexible pouch and a removable, vertically-oriented pocket strip such that the cooling sheath can be used both for freezing one or more teething pacifiers and for retaining the teething pacifiers in a frozen state until use.

FIGS. 2 through 4*b* show the utilitarian aspects of the teether pacifier 2 while FIG. 5 shows the utilitarian aspects of the cooling sheath 6 as it functions within the overall system 1.

Figure 2:
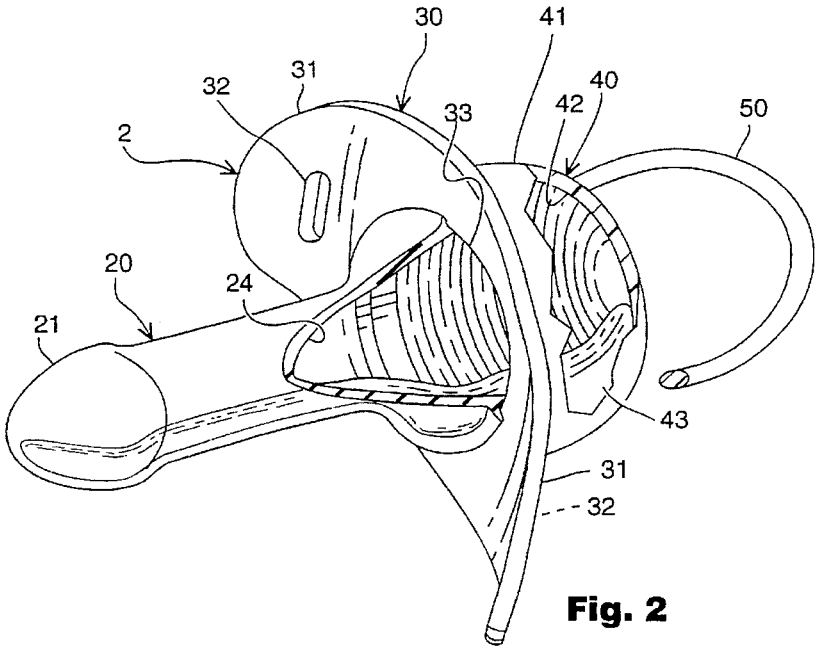
FIG. 2 shows how the teether pacifier is a flexible yet durable shell with an inner cavity partially filled with a freezable liquid such that it can be used as both a teether and pacifier.

As FIG. 2 shows, the teether pacifier 2 includes a flexible, naturally shaped nipple 20, a shield 30, a reservoir 40 and a handle 50. The thin, resilient walls of the teether pacifier 2 define a cavity 24 that extends from the head 21 of the nipple 20 through an axial opening 33 in the shield 30 and throughout the reservoir 40. The cavity 24 is filled with distilled water 43, serving as a freezable liquid, from the nipple head 21 to approximately the shield axial opening 33.

As FIG. 3 shows, when the teether pacifier 2 is sufficiently chilled in a vertical or nipple head 21 down orientation, the distilled water 43 freezes along the entire length of the nipple 20. This provides a chilled and essentially stiff surface along the length of the nipple 20 upon which an infant may bite down, relieving the discomfort that accompanies the appearance of new teeth. The elasticity of the nipple 20 along with the shield axial opening 33 and reservoir 40 serve in this case to accommodate the expansion and shrinkage resulting from freezing of the water 43.

FIG. 4*a* shows how the biting action of an infant 91 along with heat from the infant's mouth gradually cause the frozen water 43 to crumble and melt. In this case, the reservoir 40 serves to accommodate excess water 43 resulting from the potentially uneven melting process along the nipple 20. In addition, while the resiliency of the nipple material inhibits punctures during biting, using water 43 as a freezable liquid assures that the infant is not endangered should the nipple 20 nevertheless become punctured. The gradual melting and resultant increasing nipple 20 suppleness typically parallel an infant's natural tendency to tire from the work of biting.

FIG. 4*b* shows the teether pacifier 2 acting as a conventional pacifier, either through intentional bypassing of the freezing process or through complete melting of the water 43 within the cavity 24. As with a conventional pacifier, the nipple 20 must be almost completely collapsible in order to accommodate an almost effortless sucking and biting motion of a tiring infant 91. However, a large volume of water 43 for occupying approximately the full length of the nipple 20 is necessary to accommodate the nipple's use as a teether. Therefore a cavity 24 within the nipple 20, shield 30 an a specially designed reservoir 40 are needed to redistribute the water 43. As an infant sucks or bites down lazily on the nipple 20, the water 43 within the cavity 24 flows easily from the nipple 20 into the reservoir 40, thereby not obstructing the flexibility and natural feel of the nipple 20. As with conventional pacifiers, the teether pacifier 2 includes a conventional shield 30 having integral air holes 32 and a holding loop or handle 50.

The teether/pacifier 2 is comprised of a durable yet flexible rubber material not unlike that of conventional pacifiers. Both characteristics are needed to prevent rupture during freezing and thawing cycles and resultant changes in water volume. The durability further serves to prevent rupture during biting while the flexibility further accommodates easy and natural nipple 20 feel and yielding when acting as a pacifier.

FIG. 5 shows the cooling sheath 6 includes a flexible pouch 60 having an integral cover 61, compartments for conventional ice packs 62, a main compartment 63, and a detachable pocket strip 70. This arrangement is specially designed to allow for easy, compact and sanitary carrying, freezing and continued cooling of one or more teething pacifiers 2 with minimal effort by busy parents in real life scenarios. Such scenarios, for example, include crowded, often accessed and unsanitary freezers, quick response to needy infants despite ongoing activities, a need to carry additional items related and unrelated to infant care, etc.

The removable pocket strip 70 includes a number of flexible pockets 71. The pockets 71 provide a compact means for receiving, protecting and vertically orienting one or more teether/pacifiers 2 during freezing. In addition, the pocket strip 70 provides a simple sanitary and effective way to transport the teething pacifiers 2 from a freezer or other cooling device as well on a temporary basis, where continued cooling is unnecessary, prior to use. Where continued cooling is needed, it can also be inserted into the main compartment 63 of the flexible pouch 60. Conventional hook and ring strips, commonly referred to as Velcro 73, on the back of the pocket strip 70 provide additional teether/pacifier support and allow the pocket strip 70 to be affixed to the flexible pouch 60 for transport of infant related or parent related items. Similarly, Velcro strips 64, 65 and 72 are provided for closing the cover 61 of the flexible pouch 60.

Whiole the flexible pouch 60 can serve as an additional sanitary container for freezing of teething pacifiers 2, its primary purpose is for carrying, with continued cooling, one or more teething pacifiers 2 within the pocket strip 70, as well as other items in its main compartment 63.

To accommodate there real life purposes, the cooling sheath 6 and its components are comprised of a flexible, compact and durable material such as vinyl. Thus the pocket strip 70 and/or flexible pouch 60 may bbe placed in a crowded freezer or cooling device while protecting and orienting the teeting pacifiers 2 and while withstanding cycles of freezing and later thawing. The flexible pouch 60, even if containing a loaded pocket strip 70 and ice packs 92, may further be compacted into a diaper bag or other small irregular containment means.

While the above description contains many specificities, these should not be construed as limitations on the scope of the invention, but rather as an example of the preferred embodiment thereof. Many other variations are possible.

For example, it is preferred that the teether/pacifier 2 contain distilled water as the freezable fluid due to low cost and to prevent poisoning should a rupture occur. However, other liquids and/or other fluids may be used that are similarly non-toxic. Many such fluids are conventionally available having a variety of freezing and thawing properties equivalent to or superior to that of distilled water.

A second example is that the accommodation of freezing, melting and excess water distribution for a natural pacifier feel is the critical factor in determining shape, material and water volume of the teether/pacifier 2. Other shapes, particularly but not limited to that of the reservoir 40, are contemplated as are variations in water volume that do not conflict with the dual, teething and pacifying nature of the teether/pacifier 2. Similarly, the material composition may vary so long as durability required for infant safety and natural nipple feel and response needed for infant pacifying are not compromised.

A third example is that the size, shape and composition of the cooling sheath 6 may well vary and such variations are contemplated by the invention. For example, a freezing stand or pegs within the cooling sheath 6 may obviate the need for a detachable pocket strip 70 to retain proper teether/pacifier 2 orientation. Vinyl may be replaced by other conventional materials and/or insulating materials of varying thickness and/or flexibility may be used. An integral handle or carrying strap may be added. Means other than Velcro, such as snaps, may be used to seal the cooling pouch and/or to secure the pocket strip. The pocket strip may further be secured permanently, while such an arrangement provides a lesser convenience and compactness for freezing. Such variations are seen as adding to cost and bulkiness as compared with the preferred embodiment. However, the invention contemplates variations of the cooling sheath 6 that meet the requirements of conveniently receiving, protecting, orienting and cooling one or more teether/pacifiers 2.

Other embodiments are, of course, also contemplated.

I claim:

1. A teething pacifier system comprising:

at least one tubular teething pacifier having a nipple, the nipple abutting an integral shield and the shield abutting an integral reservoir; the shield having an opening therethrough; the teething pacifier also having resilient yet supple containing walls, a nipple end and a reservoir end, the containing walls defining an inner cavity extending from the nipple end through the nipple, through the opening of the shield and throughout the reservoir; the cavity containing a freezable fluid of sufficient volume such that freezing of the freezable fluid within the nipple causes the nipple to become a stiff, cooled teething surface; the reservoir being of sufficient size to accommodate expansion of the freezable fluid during freezing and to receive freezable fluid during thawing and when the freezable fluid is not frozen;

an orienting-carrying means for receiving, orienting and transporting a plurality of said teething pacifiers, such that each teething pacifier is protected from contamination during freezing and transportation, the orienting-carrying means comprising a carrier sufficiently durable, thin and flexible to withstand repeated freezing and thawing;

said carrier comprising a plurality of compartments; a plurality of said compartments being configured to receive conventional ice-packs for keeping the pacifiers chilled;

a pocket strip comprising a plurality of pacifier-receiving pockets sized and configured for orienting each of the pacifiers such that the freezable fluid in each pacifier is essentially contained in the nipple; at least one of said compartments in said carrier being sized to receive said pocket strip; and cooperating means on an exterior of said carrier and on said pocket strip for removably attaching the pocket strip to the carrier.

2. A teething pacifier system as described in claim 1 wherein the carrier of the orienting-carrying means further comprises a cover and a carrying strap.

3. A teething pacifier system as described in claim 1 wherein the carrier is composed of a flexible material, such that the carrying pouch can be compressed as needed to conserve space and to be easily received by small, irregular containment means.

* * * * *